US008678208B2

(12) United States Patent
Richter

(10) Patent No.: US 8,678,208 B2
(45) Date of Patent: Mar. 25, 2014

(54) CRANE

(75) Inventor: Yggve Richter, Blaubeuren (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 0 days.

(21) Appl. No.: 13/299,545

(22) Filed: Nov. 18, 2011

(65) Prior Publication Data

US 2012/0125875 A1 May 24, 2012

(30) Foreign Application Priority Data

Nov. 18, 2010 (DE) ..... 20 2010 015 616 U

(51) Int. Cl.
*B66C 13/06* (2006.01)

(52) U.S. Cl.
USPC ..... 212/273; 212/272

(58) Field of Classification Search
USPC ..... 212/272–274, 223, 255
IPC ..... B66C 13/08,13/06
See application file for complete search history.

(56) References Cited

U.S. PATENT DOCUMENTS

| | | | | |
|---|---|---|---|---|
| 6,439,407 | B1 * | 8/2002 | Jacoff et al. | 212/274 |
| 6,644,486 | B2 * | 11/2003 | Jacoff et al. | 212/274 |
| 2008/0216301 | A1 * | 9/2008 | Hansen et al. | 29/428 |
| 2011/0272377 | A1 * | 11/2011 | Willim et al. | 212/285 |
| 2012/0061341 | A1 * | 3/2012 | Richter | 212/348 |

FOREIGN PATENT DOCUMENTS

| | | |
|---|---|---|
| DE | 202006015189 | 2/2008 |
| DE | 202010003269 | 8/2011 |
| FR | 2926805 | 7/2009 |
| WO | 2008/061797 | 5/2008 |

* cited by examiner

*Primary Examiner* — Emmanuel M Marcelo
*Assistant Examiner* — Angela Caligiuri
(74) *Attorney, Agent, or Firm* — Dilworth & Barrese, LLP.

(57) ABSTRACT

The present invention relates to a crane having a load hook directly/indirectly fastened to the crane hoist rope and having a frame suspended at the load hook for taking up a special load, in particular for taking up a rotor blade of a wind turbine, wherein the control element(s) of a frame suspended at the load hook is/are guided along a guider rope region of the crane hoist rope.

21 Claims, 4 Drawing Sheets

CRANE

The invention relates to a crane having a load hook fastened directly/indirectly to the crane hoist rope and having a frame suspended at the load hook for taking up a special load, in particular for taking up a rotor blade of a wind turbine.

BACKGROUND OF THE INVENTION

On assembling wind turbines, the rotor blades have to be attached at a large lifting height. Mobile cranes or crawler cranes are preferably used for this purpose. The rotor blade to be mounted has a large rotor surface and consequently a large exposed surface for the wind. To mount the rotor blade at the corresponding wind turbine, a sufficiently precise adjustment and stabilization of the taken-up rotor blade at the mounting height is required.

It is already known from the prior art for this purpose to take up the rotor blade by means of a blade. The latter is suspended at the load hook of the hoist rope and takes up the rotor component to be mounted in the corresponding mount.

It is, for example, proposed in DE 2006 015 189 U1 to fasten rotor blades via two control ropes at the two guy ropes of the Y-guying system of the main boom and to secure them against rotation. A disadvantage of the proposed solution is that the guy ropes run far away from the longitudinal axis of the main boom. The forces in the horizontally extending control ropes consequently substantially influence the guying forces of the Y-guying system and reduce the payload of the crane.

Constructions are furthermore known in which one or more additional ropes, also called guide ropes, is/are tensioned by means of at least one additional winch starting from the boom foot to the boom head. The mount for the rotor blade is connected via two control ropes to the tensioned rope or ropes.

The decisive disadvantage of these solutions now comprises the fact that additional winches and rope arrangements are absolutely necessary. The additional equipment articles mean, however, a disadvantageous weight increase of the crane and simultaneously an increasing production cost effort and servicing effort. Furthermore, it is necessary in solutions using two additional ropes to tension both ropes independently of one another. The tensioning force introduced per rope loads the boom since the resulting pressure load acts as an additional load on the boom. The attachment of two independent ropes likewise induces an additional lateral load on the boom if one rope is loaded more.

SUMMARY OF THE INVENTION

The object of the present invention is now to provide an improved guidance possibility for the control elements of a frame which can be realized comparatively simply and inexpensively.

This object is achieved by a crane having the features herein. Advantageous embodiments of the invention are also the subject matter herein.

The crane in accordance with the invention includes a load hook which can be fastened directly/indirectly to the crane hoist rope and to which a frame for mounting a special load is fastened. The frame is in particular suitable for taking up a rotor blade of a wind turbine.

Such frames are also called "yokes" in technical language. This is a frame which takes up the actual load in a gentle and damage-free manner. The connection between the toad hook and the frame is expediently established via suspension means. To align and stabilize the yoke, it has independently working assemblies such as winches, drives, operating means, etc.

The frame used has at least two control elements indirect communication with the crane boom for adjusting, stabilizing and finely aligning the frame or the load taken up. In accordance with the invention, it is now provided that the at least two control elements are guided along a guide rope region of the crane hoist rope. A region of the hoist rope used is accordingly created which provides a guidance possibility for the connected control elements. The attachment of a separate guide rope is consequently superfluous. Separate winches haying a corresponding hydraulic and electric control to tension the separate guide rope or ropes are likewise superfluous. The proposed solution considerably simplifies the crane production and is furthermore substantially less expensive than known designs.

The technical performance of the invention is independent of the type of main boom used. It can, for example, be either a lattice mast boom or a telescopic boom.

A partial region of the hoist rope is preferably used as a guide rope region which extends parallel to the longitudinal boom axis at the boom side facing the load. It can be expedient for this purpose that the hoist rope is guided from the crane hook back to the boom and is tensioned parallel to the longitudinal boom axis in the direction of the boom foot. The region of the hoist rope guided back is advantageously used as a guide rope region.

In a particularly advantageous embodiment of the crane, the guide rope region of the hoist rope is formed by the hoist rope which is guided back from the hock-type block via at least one pulley block at the boom in the direction of the longitudinal boom axis to the lower crane attachment point. At least one pulley block is furthermore expediently arranged at the roller head of the boom tip. One or more pulley blocks can preferably be provided at any desired point of the boom. For example at the main boom, at the boom extension or at the needle. For example the hub height of a wind turbine to be installed can be decisive.

At least one deflection pulley is advantageously installable or installed at a variable height at the crane boom in the guide rope region of the hoist rope. The mounting of the pulley block can take place, for example, in coordination with the target hoist height of the load to be achieved. The pulley is preferably bolted to the crane or is fastened to the crane by means of clamping means.

One or more control elements are particularly preferably configured as control ropes. Accordingly, at least two control ropes of the suspended frame are guided along the guide rope region of the hoist rope. The use of a control chain and/or of a spindle and/or of a cylinder and/or of a telescopic rod and/or of an articulated link is generally conceivable. The use of an element based on a scissors mechanism is furthermore also conceivable. The design is expediently identical for at least some of the control elements; however, any desired combination of the proposed embodiments is also possible.

The end-side attachment point of the hoist rope guided back is preferably at the pivot connection piece of the crane boom. The hoist rope can selectively be attached at the end side to the luffing ram or also to the revolving deck.

Provision can advantageously be made that a rope clamp is arranged at the hoist rope end. The hoist rope end can be attachable or attached to any desired point of the crane via the rope clamp depending on the specification profile.

The handling of the hoist rope end preferably takes place with the aid of an installation rope which is arranged at the end side at the hoist rope or rope clamp and which is either accessible from the footprint of the crane or alternatively via a drive. It is conceivable to operate the installation rope, in particular to wind it up or unwind it, by means of at least one winch. An already present installation rope of the reeving winch can be used as the installation rope, for example.

In an advantageous embodiment of the invention, at least one pulley block arranged in the guide rope region of the hoist rope includes an apparatus for intercepting or fixing at least one guided control element. The control elements slide, in particular by means of a fastened connection link, along the guide rope region of the guide rope in dependence on the hoisting height. The apparatus serves for fixing and stabilizing the control elements, in particular the connection link, so that a precise control or fine adjustment of the frame can be ensured with the aid of the control elements.

The pulley block is in particular arranged at the crane such that the control elements or the connection link can be intercepted or fixed at the target hoist height of the taken up load to be reached. A pulley block designed variably installable at the boom preferably has the apparatus for intercepting and fixing. The installation of the pulley block takes place, for example, in the hub height region of a wind turbine to be installed. The attachment of the named pulley block just below the hoisting height to be achieved so that a premature interception and fixing of the control elements results in a specific and advantageous oblique pull of the control elements is particularly advantageous. The oblique pull boosts the achieved fixing of the control elements.

The apparatus of the pulley block advantageously comprises at least one plate which is pivotably supported about the pulley block axis and which has at least one abutment surface. The pivotable support of the plate ensures a targeted alignment of the abutment surface in dependence on the rope redirected by the pulley block.

The abutment surface is in particular arranged at the lower side of the plate and the rope is guided through the abutment surface orthogonally thereto. The rope particularly preferably runs orthogonally through the surface center of the abutment surface. The vertical movement of the control elements sliding on the rope can consequently be limited to a maximum height by the abutment surface.

The plate of the apparatus preferably includes at least one holding roller which ensures a soft and damped positioning of the plate at the rope. This is in particular advantageous if the plate is deflected in any desired direction, which consequently results in an increase in the rope looping angle of the redirected rope at the pulley block. The pulling force arising in the rope acts as a restoring force and is taken up in damped form by the plate due to the holding roller.

A connection link is advantageously provided which is suitable for connecting at least one control element to the guide rope region of the hoist rope. The connection link preferably has at least one abutment surface which can be brought into abutment with the suitable counter-abutment surface of the pulley block described above. A fixing/stabilizing of the connection link at the pulley block is achieved by the targeted abutment between the connection link and the pulley block.

At least one slide block is preferably provided in the region of the abutment surface of the connection link. A targeted abutment of the two abutment surfaces is ensured with the aid of the slide block. The slide block furthermore effects an improved shape matching between the pulley block and the connection link in the intercepted position of the connection link.

The connection link is preferably configured rotatably about the rope axis of the hoist rope so that the movability of the control elements is not restricted or is only slightly restricted. In the intercepted state of the connection link, the slide block preferably slides about the surface periphery of the abutment surface of the pulley block.

The invention furthermore relates to a pulley block having an apparatus for intercepting and fixing at least one control element or one connection link respectively. The pulley block obviously has the same features and properties as the preceding embodiment of the crane so that a repeated discussion will be dispensed with at this point.

The invention further relates to a connection link which can be intercepted or fixed at the pulley block with a corresponding apparatus. The connection link obviously has the same features and properties as the preceding embodiment of the crane so that a repeated discussion will be dispensed with at this point.

It is worthy of mention in this connection that the pulley block and the connection link can naturally also be used at a separate guide rope, not to be associated with the hoist rope, of any desired crane.

BRIEF DESCRIPTION OF THE DRAWINGS

Further advantages and particulars of the invention will be explained in detail with reference to an embodiment shown in the figures. There are shown.

DESCRIPTION OF THE PREFERRED EMBODIMENTS

Figure 1:
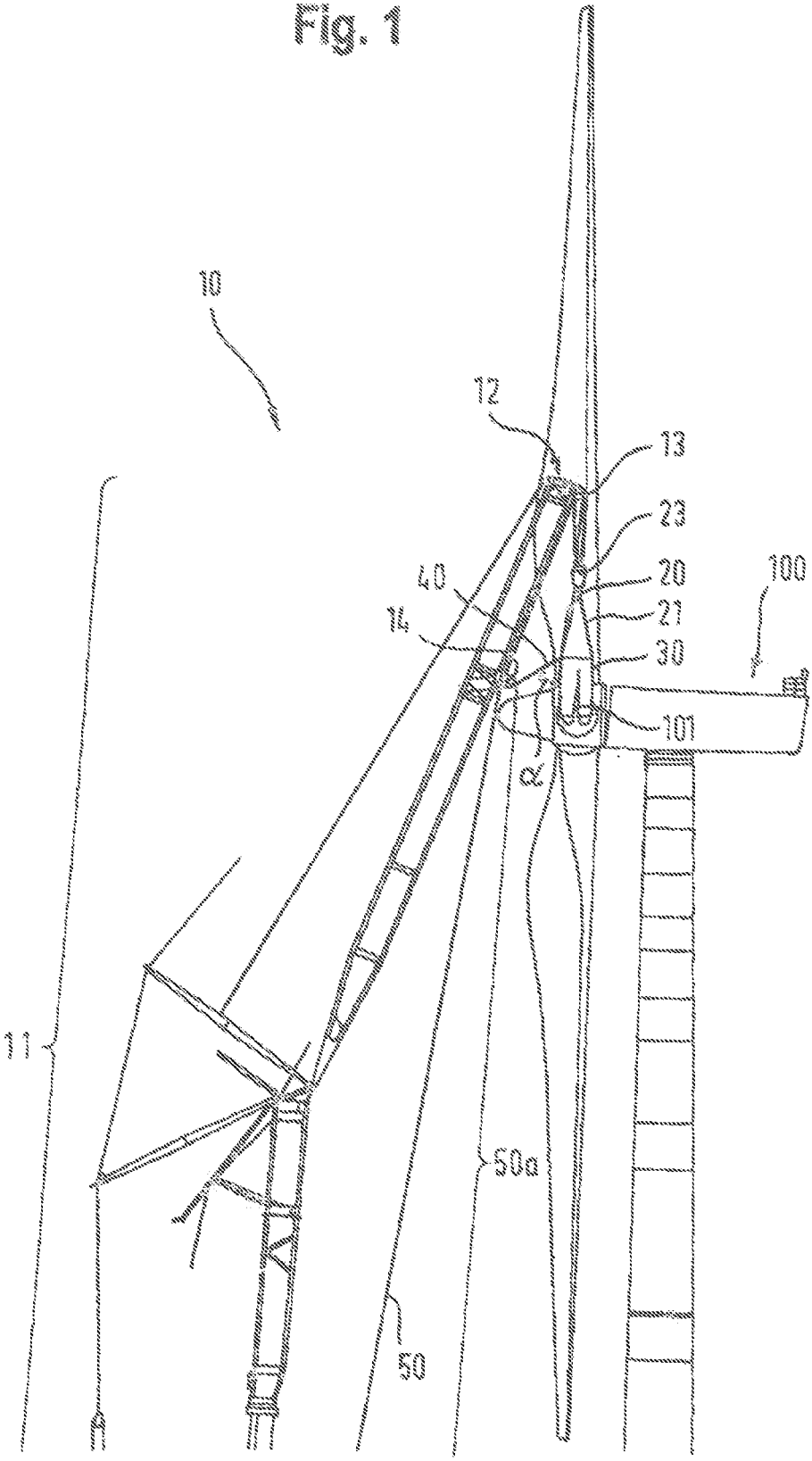
FIG. 1: a side view of the crane in accordance with the invention with a taken-up rotor blade of a wind turbine.

FIG. 1 shows a crane structure 10 for the installation of wind turbines 100. The specific embodiment of the crane structure 10, in particular of the boom system 11, is not significant for the invention. The idea in accordance with the invention can generally be used with any type of boom systems 11 such as with a lattice mast crane as well as a telescopic crane.

A yoke 30 is suspended via the suspension means 21 at the load hook 20. The yoke 30 includes a frame which takes up a rotor blade 101 of the wind turbine 100 to be raised in a gentle and damage-free manner. The yoke 30 furthermore includes a series of independently working assemblies, such as winches, drives, operating means, which serve inter alia for actuating the outgoing control ropes 40.

The control ropes 40 are directly connected to the boom system 11 for the adjustment and stabilization of the yoke 30. In contrast to the prior art, no additional guide rope is spanned at the boom system 11 as a guide possibility of the control rope 40. To simplify the crane design and as part of the cost minimization, instead the hoist rope 50 of the crane 10 is used.

The hoist rope 50 extends from the roller head 12 to the hook-type block 23 in order to be guided back to the boom system 11 after a load-dependent reeving at the hook-type block 23. In detail, the rope course of the hoist rope 50 running back from the hook-type block 23 is determined by the pulley block 13 arranged at the roller head 12 and by the pulley block 14 mounted on the boom system 11 at the height of the rotor hub. At the end side, the hoist rope is attached to the lower abutment point, not shown, which is located at the pivotal connection piece, at the lung ram or at the revolving deck of the crane in dependence on the set hoisting conditions or on the crane design. In the drawing shown, the partial region 50*a* of the hoist rope 50, which runs from the pulley block 14 to the lower pivotal connection point parallel to the boom axis, is used as a guide rope region 50*a*.

Figure 2:
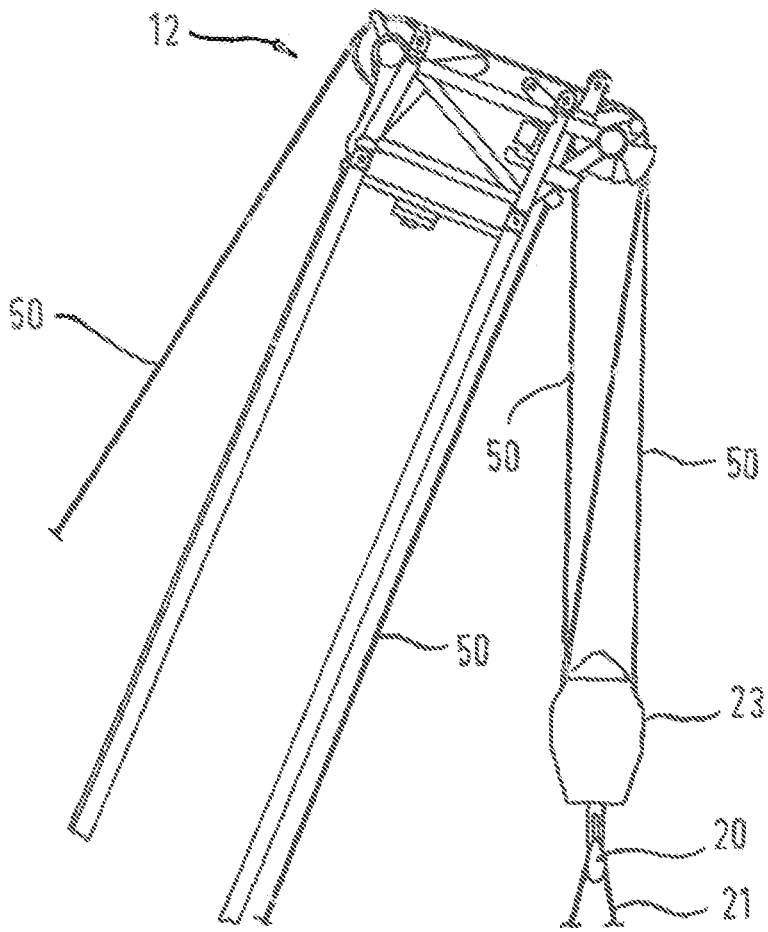
FIG. 2: a detail representation of the roller head in accordance with FIG. 1.

An enlarged illustration of the roller head 12 can be seen from FIG. 2. This again provides an exact overview of the specific rope extent of the hoist rope 50 at the roller head 12.

If the yoke 30 together with the rotor blade 101 is suspended at the hook-type block 23, a sufficient tension of the hoist rope 50 then results in the guide rope region 50*a*. The installation of the rotor blade 101 at the wind turbine 100 already results in a substantial reduction of the hoisting load. This immediately has effects on the pulling force in the hoist rope 50 and consequently on the tension in the guide rope region 50*a*. At the same time, however, a large part of the wind attack surface is omitted so that the hoist rope tension is sufficient to avoid a dangerous rotating with the load-relieved yoke 30.

The number of reevings of the hoist rope 50 at the hook-type block 23 is selected in dependence on the yoke 30 used. There is the possibility of using yokes with different physical dimensions which are especially configured for different rotor blades having different geometrical dimensions and weights. The total weight of the yoke 30, the hook-type block 23 and the taken-up rotor blade 101 must be considered for the reeving. The number of reevings reduces the pulling force at the hoist rope. This is necessary in order to not allow the pulling force in the rope to become higher than permitted. This effect is actually unwanted in the region 50*a*, even though it is unalterable.

The pulley block 14 is attached just below the target height (hub height) at the boom system 11 to be reached by the upper yoke edge. Even before the yoke 30 reaches the target height, the control ropes 40 running along on the guide rope region 50*a* of the hoist rope 50 by means of connection link 60 abut the pulley block 14 especially configured therefor. The direct abutment of the connection link 60 at the pulley block 14 is assisted by a moving of the connection link 60 into a corresponding apparatus 200 at the pulley block 14; and The reasons for this abutment is that, at the ultimately reached hoisting height (height for the installation of the rotor blade 101 at the wind turbine 100), the connection link 50 is laterally fixed by the pulley block 14 or by the apparatus 200 so that the yoke 30 can be controlled and positioned very precisely via the control ropes 40 in this case.

Since the hub height of the wind turbine 100 and thus the moved out state of the boom system 11 is known, the pulley block 14 can be bolted to the boom system at the corresponding height on the basis of this knowledge to achieve a fixing of the connection link 60. To be very free in the positioning of the pulley block 14, the counter-connection elements at the boom are realized via clamping, bolt connections or other fixing mechanisms.

Since a certain horizontal pull a of the control ropes 40 can be tolerated (the yoke 30 has to be configured for this), a matching bolting point for the pulley block 14 will be found for each hub height of the wind turbine 100. The pull $\alpha$ is desired since the connection link 60 can hereby be held in engagement better.

Figure 3:
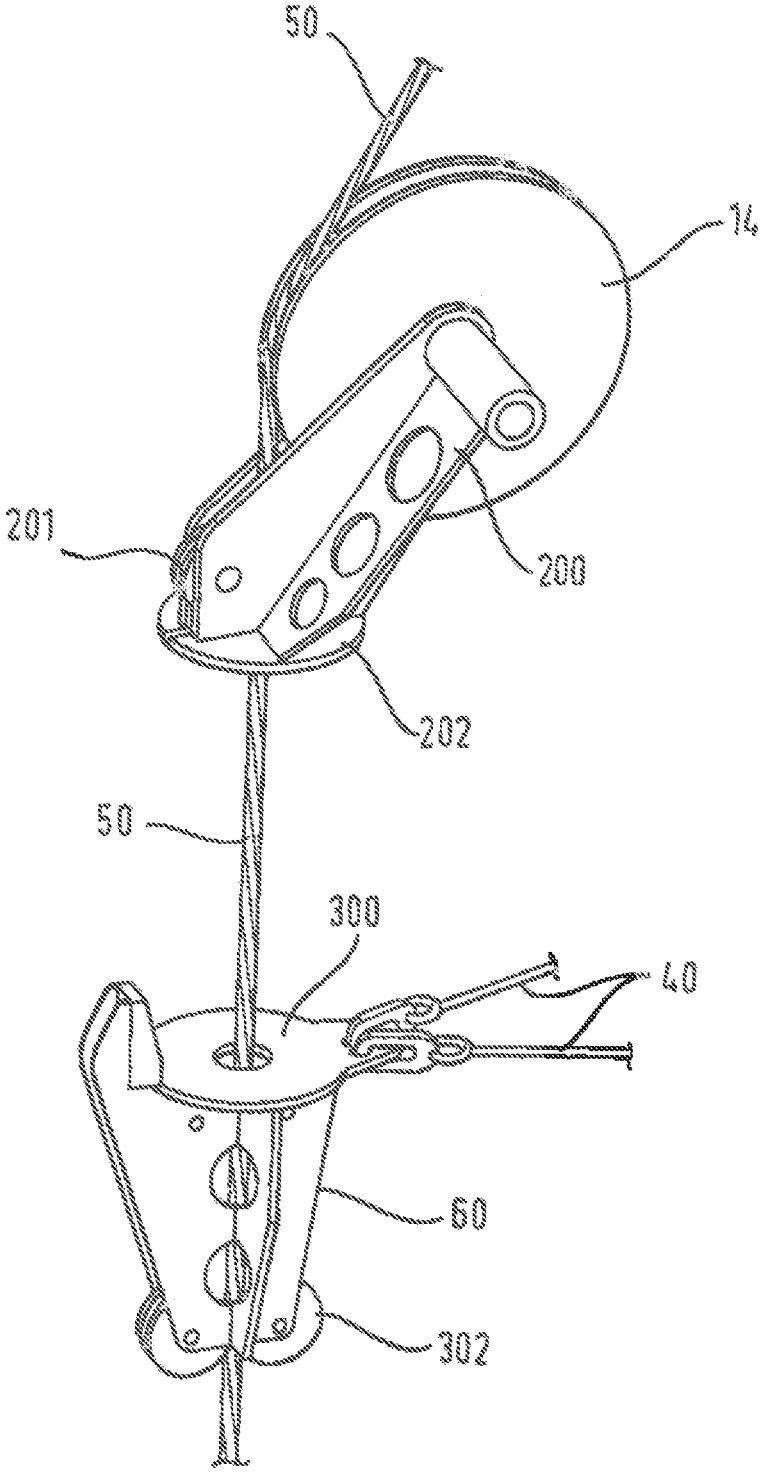
FIG. 3: a schematic diagram of the pulley block in accordance with the invention for intercepting the connection block in a perspective view.
Figure 4:
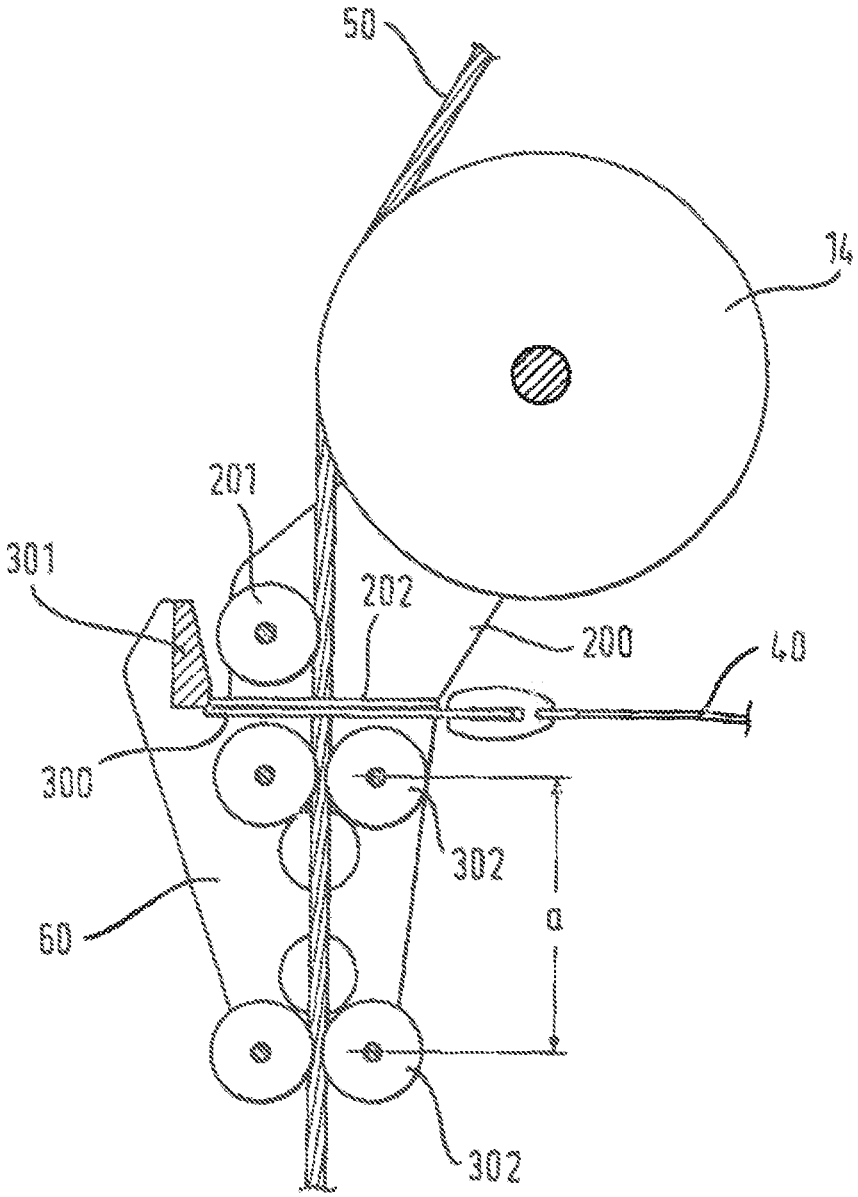
FIG. 4: a sectional representation of the apparatus of FIG. 3 with an intercepted connection link.

An embodiment of the pulley block 14 and of the connection link 60 can be seen from the schematic diagram of FIG. 3 as well as from the corresponding sectional representation in FIG. 4. The pulley block 14 is stiffly positioned with its axis of rotation at the boom system 11. The plate 200 is suspended at the pulley block 14 and is pivotally supported about the axis of the pulley block. The plate 200 furthermore carries a holding roller 201 which positions the plate 200 softly and damped by the hoist rope 50. If, for example, the plate should be pivotally connected to the right, the coil angle of the hoist rope 50 about the pulley block 14 then increases in this respect. The pulling force acts as a restoring force in the hoist rope 50.

The plate 200 has a metal abutment sheet 202 at its lower side, said metal abutment sheet not fully surrounding the hoist rope 50. The center of the circular metal abutment plate 202 lies on the longitudinal axis of the hoist rope 50.

The connection link 60 likewise has a plate, the metal abutment sheet 300, whose shape corresponds to the metal abutment sheet 202 of the pulley block 14. The interception and holding procedure is as described in the following.

The connection link 60 is taken along by the yoke 30 pulling upwardly via the control ropes 40. When the two metal abutment sheets 202, 300 approach one another, they are aligned to one another via the slide block 301 of the connection link 60 until both metal abutment sheets 202, 300 lie on one another, as explicitly shown in FIG. 4. The system is now connected in shape-matched form via the slide block 301 so that forces from the control ropes 40 can be transmitted from the slide block 301 onto the metal abutment sheet 202 of the pulley block 14.

The connection link 60 is furthermore still rotatable about the rope axis and can be aligned in accordance with the control rope forces. In this case, the slide block, 301 slides on the outer side of the metal abutment sheet 202 with the hoist rope 50 as the center.

The connection link 60 held at abutment can only move minimally perpendicular to the hoist rope 50 due to the large spacing "a" of the link rollers 302 and thus guarantees a fixed point at which the control ropes 40 of the yoke 30 can engage. A precise and fast installation of the rotor blade 101 is made possible.

The crane 10 in accordance with the invention also still has to be able to raise heavy loads without any larger reequipping. A particularly heavy load on the installation of wind turbines 100 is, for example, represented by the machine house. The reeving of the hoist rope 50 at the hook-type block 23 is selected accordingly; however, in this extreme load case, the introduction of the additional force in the guide rope region 50*a* of the hoist rope 50 into the boom system 11 should be avoided at all costs. The hoist rope 50 is fastened to the boom system 11 at the end side by rope clamping for this reason. Depending on the load type, the guide rope region 50*a* can be enlarged, reduced or omitted due to the fastening possibility variable at the end side.

For example, the machine house of the wind turbine 100 is first brought into the installation position. For this purpose, the end of the hoist rope 50 is held at the upper end of the boom system 11 via the rope clamp. A guide rope region 50*a* is not necessary due to the small wind attacking surface.

Subsequently to this, the yoke 30 is fastened to the hook-type block 23. In this respect, the rope clamp, to whose end the installation rope of the reeving winch of the crane 10 is fastened, is pulled over the reeving winch to the boom section and is suspended.

The invention claimed is:

1. A crane (10) having a load hook (20) fastened directly/indirectly to a crane hoist rope (50) and having a frame (30) suspended (21) at the load hook (20) for taking up a special load, wherein at least one control element (40) of the frame (30) is suspended via suspension means (21) at the load hook (20)

and positioned to be guided along the crane hoist rope (50) itself and on a section thereof forming a guide rope region (50*a*) of the crane hoist rope (50) by a connection link (60) movably mounted on the hoist rope (50).

2. The crane in accordance with claim 1, wherein the guide rope region of the hoist rope is formed by the return guidance of the hoist rope from a hook-type block via at least one pulley block in the same direction as a longitudinal boom axis up to a lower abutment point at the crane.

3. The crane in accordance with claim 2, wherein the guide rope region (50*a*) of the hoist rope (50) extends away from a boom (11) of the crane (10) after passing around both the pulley block (14) mounted upon the boom (11) and hook-type block (23) and down towards a lower pivotal connection point parallel to a boom axis.

4. The crane in accordance with claim 2, wherein the pulley block (14) is situated just below a target height of a boom (11) to be reached by an upper edge of the frame (30).

5. The crane in accordance with claim 1, wherein at least one pulley block is installable in the guide rope region (50*a*) of the hoist rope in a variable height at a crane boom.

6. The crane in accordance with claim 1, wherein the at least one control element is a control rope.

7. The crane in accordance with claim 6, wherein the control rope (40) is directly connected to a boom system (11) of the crane (10).

8. The crane in accordance with claim 1, wherein at least one pulley block in the guide rope region has an apparatus for intercepting or fixing the at least one control element and the connection link.

9. The crane in accordance with claim 8, wherein the apparatus includes at least one plate pivotably supported about the pulley block axis and having at least one abutment surface.

10. The crane in accordance with claim 9, wherein the abutment surface is arranged at the lower plate side and the hoist rope runs almost orthogonally through the abutment surface.

11. A crane in accordance with claim 10, wherein the rope runs orthogonally through a surface center of the abutment surface.

12. The crane in accordance with claim 9, wherein the plate has at least one holding roller for the damped guidance of the plate along the rope.

13. The crane in accordance with claim 8, wherein the connection link has at least one abutment surface for intercepting or fixing the connection link at the pulley block with the apparatus.

14. The crane in accordance with claim 13, wherein a slide block is provided in the region of the abutment surface of the connection link.

15. The crane in accordance with claim 14, wherein the connection link is rotatable about the rope axis and the slide block slides in the intercepted or fixed state about the surface periphery of the abutment surface of the pulley block.

16. The crane in accordance with claim 1, additionally comprising a the pulley block (14) mounted on a boom (11) of the crane (10) and the at least one connection link (60) positioned along the guide rope region (50*a*) of the hoist rope (50) underneath pulley block (14).

17. The crane in accordance with claim 16, wherein the at least one connection link (60) is directly abuttable with the pulley block (14).

18. A crane in accordance with claim 1, wherein the crane hoist rope (50) is wound about a roller head (12) situated on a tip of an uppermost or outermost boom of a boom system (11) and into engagement with the load hook (12), and the at least one control element (40) is positioned along the hoist rope (50) and a location below the roller head (12) when the boom system (11) is raised.

19. A crane (10) having a load hook (20) fastened directly/indirectly to a crane hoist rope (50) and having a frame (30) suspended (21) at the load hook (20) for taking up a special load, wherein at least one control element (40) of the frame (30) suspended via suspension means (21) at the load hook (20) is positioned to be guided along the crane hoist rope (50) on a guide rope region (50*a*) of the crane hoist rope (50), at least one connection link (60) is positioned to guide the at least one control element (40) along the guide rope region (50*a*) of the hoist rope (50), additionally comprising a pulley block (14) mounted on a boom (11) of the crane (10) and the at least one connection link (60) positioned along the guide rope region (50*a*) of the hoist rope (50) underneath the pulley block (14), wherein the at least one connection link (60) is directly abuttable with the pulley block (14), a plate (200) suspended from the pulley block (14) and pivotally supported about an axis of the pulley block (14), a holding roller (201) carried by the plate (200) for positioning the plate (200) against the hoist rope (50), and a first circular metal abutment sheet (202) at a lower side of the plate (200) and not fully surrounding the hoist rope (50), with a center of the first circular metal abut sheet (202) lying on a longitudinal axis of the hoist rope (50), wherein the at least one connection link (60) comprises a second metal abutment sheet (300) corresponding in shape to the first metal abutment sheet (202) of the plate (200) suspended from the pulley block (14), and a slide block (301) laterally arranged against the second metal abutment sheet (300), such that when the first and second metal abutment sheets (202, 300) approach one another, the slide block (301) aligns the first and second metal abutment sheets (202, 300) to lie on one another and couple the at least one connection link (60) and pulley block (14) in shape-matched form and transmit force from the at least one control element (40) onto the first metal abutment sheet (202) of the pulley block (14).

20. The crane in accordance with claim 19, wherein the at least one connection link (60) comprises a pair of link rollers (302) separated a distance from one another in a direction along the longitudinal axis of the hoist rope (50), and each said roller pair (302) positioned to contact the hoist rope (50) extending therebetween.

21. The crane according to claim 20, wherein the at least one control element (40) is constituted by a pair of control ropes (40), with each said control rope (40) clipped onto the sheet (300) of the at least one connection link (60).

* * * * *